United States Patent [19]

Chan

[11] Patent Number: 4,477,981

[45] Date of Patent: Oct. 23, 1984

[54] DYNAMIC DRYING SIMULATOR

[75] Inventor: Lawrence W. Chan, New City, N.Y.

[73] Assignee: Royal E. Bright, New York, N.Y.

[21] Appl. No.: 503,387

[22] Filed: Jun. 10, 1983

[51] Int. Cl.[3] ..... F26B 3/20

[52] U.S. Cl. ..... 34/41; 34/163; 34/207; 34/89

[58] Field of Search ..... 100/93 RP, 176; 38/7, 38/8, 9, 10, 11; 219/388; 34/41, 42, 143, 144, 151, 163, 207, 89

[56] References Cited

U.S. PATENT DOCUMENTS 4,415,610 11/1983 Choinski ..... 427/372.2

4,438,570 3/1984 Dokoupil ..... 34/151

*Primary Examiner*—Larry I. Schwartz

*Attorney, Agent, or Firm*—Royal E. Bright

[57] ABSTRACT

A simulator for simulating on a test sheet the actions of a dryer section of a paper making machine. The simulator includes a closed chamber to which there is connected a temperature and humidity control system to maintain the chamber in constant temperature and humidity during a test. A dryer fabric web is mounted within the chamber and is so guided as to have two parallel runs thereof in closely spaced relation. A holder is provided for mounting a test sheet between the two runs. Dryers are mounted above and below the two runs. The dryer fabric has openings therein which are selectively positioned in centered relation along the two runs so that the upper dryer may pass through an upper opening, pick up a test sheet and press the same against the dryer fabric of the lower run. Then the dryers are moved upwardly, the dryer fabric shifted the align the other opening along the lower run and then the lower dryer may pass through the lower opening and engage the test sheet from the opposite side so as to force the same upwardly against the dryer fabric of the upper run. The dryers may have circumferentially spaced separate heads and the dryers are mounted for timed rotation to present a new head upon each engagement of the test sheet by a respective one of the dryers.

20 Claims, 13 Drawing Figures

DYNAMIC DRYING SIMULATOR

This invention relates to an apparatus for simulating the drying process of a papermaking machine.

The optimization of dryer sections in paper machines is one of the biggest challenges in the papermaking industry. A significant amount of research work has already been conducted in an attempt to understand the heat and mass transfer mechanisms in paper drying. However, most of the work is too theoretical and can hardly be applied in practice. For many years there have been very few breakthroughs in drying technology. A major obstacle in optimizing the dryer sections is difficulty in making on-line measurements of moisture and paper properties of a high speed web in each and every dryer. Any development in overcoming this obstacle would obviously open the opportunities to improve the water removal rate as well as the paper properties.

In accordance with this invention there has been provided an apparatus which will simulate the drying process of a papermaking machine.

In accordance with this invention, a dryer fabric web is so mounted as to have two adjacent runs between which a test sheet holder is mounted. The dryer fabric has two openings therethrough which are selectively centered with respect to the test sheet holder whereby one of two opposed dryers may pass through one run of the dryer fabric for engaging test sheet carried by the holder and clamping the same against the dryer fabric of the other dryer fabric run. The one dryer is then retracted, the dryer fabric is moved so as to position the other opening therein along the other dryer fabric run in alignment with the test sheet holder, and thereafter a second of the dryers passes through its associated opening in the dryer fabric so as to pick up the test sheet and advance the same into clamped relation against the dryer fabric.

Suitable mechanism is provided for effecting the automatic timed operation of the apparatus. Further, the apparatus is mounted within a chamber to which there is connected a temperature and humidity control system for maintaining the chamber at a constant temperature and humidity during testing. The test apparatus of this invention simulates the ambient conditions in a papermaking machine. The paper sample, termed a handsheet, is measured for moisture content after removal from the apparatus. The simulator of this invention duplicates variations in pocket temperature, pocket humidity, fabric tension and dryer temperature of a papermaking machine.

IN THE DRAWINGS

FIGS. 8*a, b* and *c* are schematic views showing the movement of the dryer fabric and the dryers to effect a drying of a test sheet by a first of the dryers.

FIG. 9*a, b,* and *c* are further schematic views showing the movement of the dryer fabric and the dryers for the engagement of the test sheet by a second of the dryers.

Figure 1:
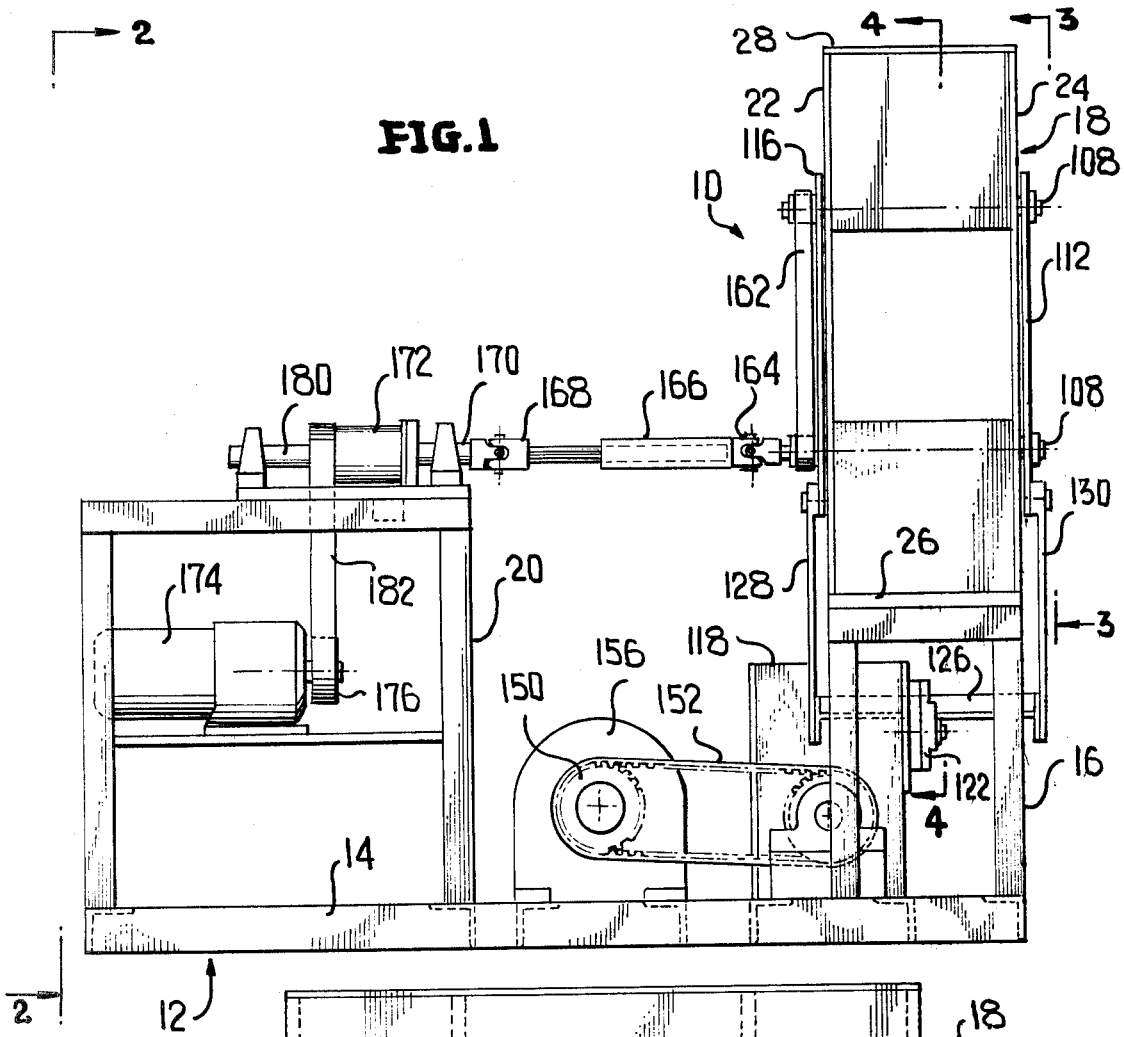
FIG. 1 is an end view of the apparatus and shows the general details thereof.

Referring now to the drawings in detail, it will be seen that there is illustrated a paper dryer simulator which is generally identified by the numeral 10. The simulator 10 includes a base frame structure, generally identified by the numeral 12. The base frame structure 12, as is best shown in FIG. 1, includes a base 14, which has mounted at one end thereof an upstanding frame structure 16 on which there is mounted an upstanding and elongated chamber generally identified by the numeral 18. At the opposite end of the base 14 there is a second upstanding frame 20.

Figure 4:
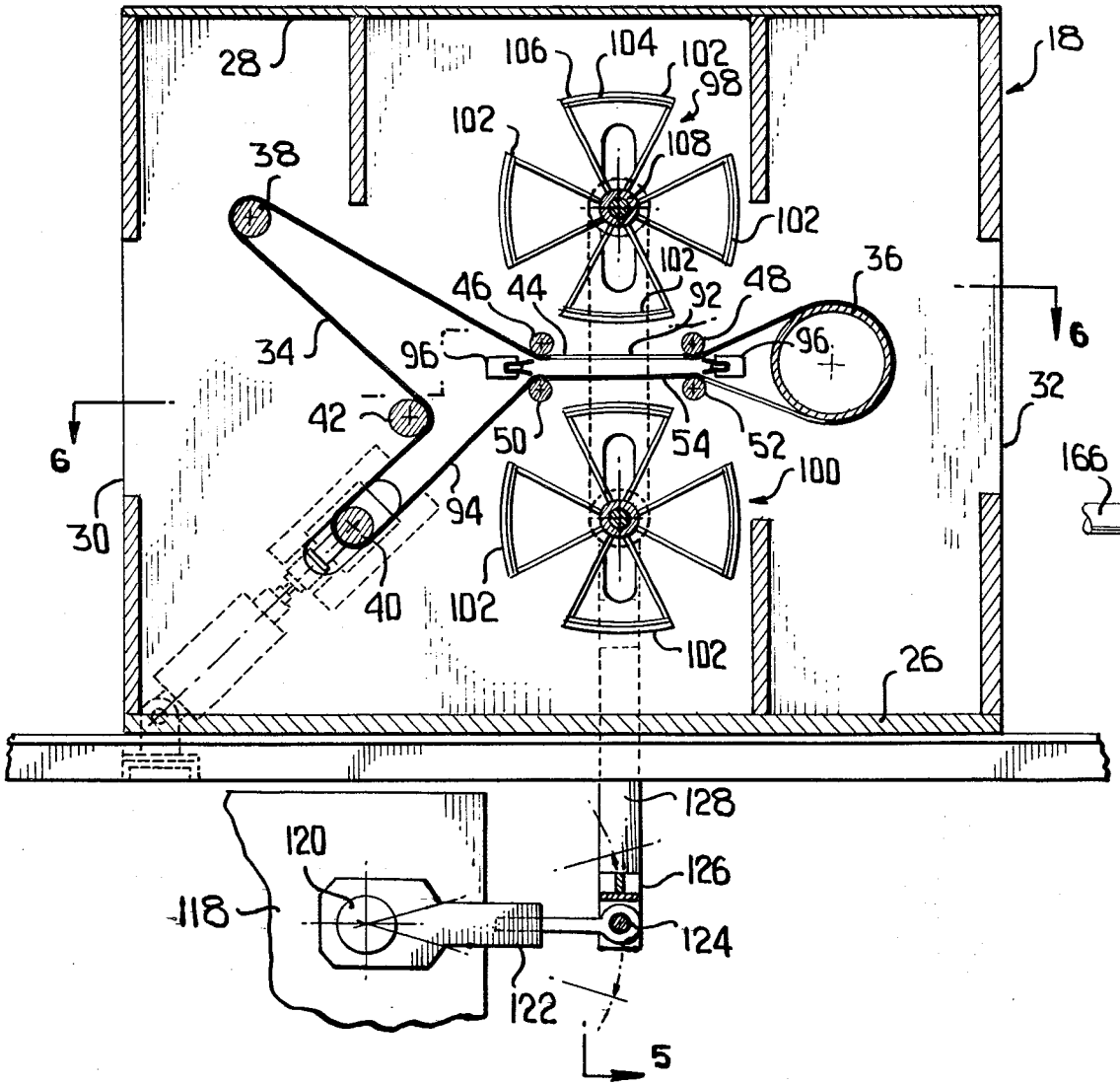
FIG. 4 is a fragmentary vertical sectional view taken through the apparatus generally along the line 4—4 of FIG. 1 and shows the specific details of the mounting of the dryer fabric and the dryers.

The chamber 18 is defined by a front panel 22 and a rear panel 24 which are arranged in parallel relation and which are connected together by a bottom wall 26 and a top wall 28. There are also end walls 30 and 32, as is best shown in FIG. 4. The walls of the chamber 18 are reinforced and connected together in any suitable manner.

Referring now to FIG. 4 in particular, it will be seen that mounted within the chamber 18 is a dryer fabric web 34. The web 34 is continuous and passes around a positioning drum 36, an idler roller 38 and a tensioning roller 40. There is also an idler roller 42 between the tensioning roller 40 and the idler roller 38. Further, the dryer fabric 34 between the positioning drum 36 and the idler roller 38 is arranged as a straight line run 44 by a pair of positioning rollers 46, 48. In a like manner, a portion of the dryer fabric 34 between the positioning drum 36 and the tensioning roller 40 is supported by a pair of positioning rollers 50, 52 to define a second run 54 which is closely spaced from and is parallel to the run 44.

Figure 3:
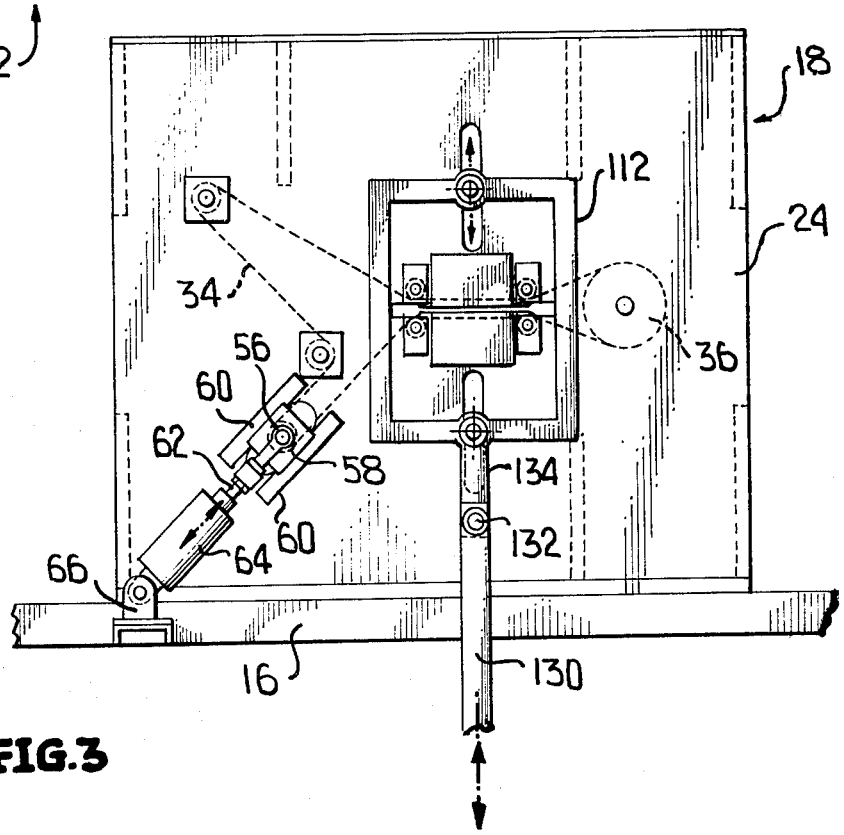
FIG. 3 is a fragmentary rear elevational view of the apparatus taken generally along the line 3—3 of FIG. 1.
Figure 2:
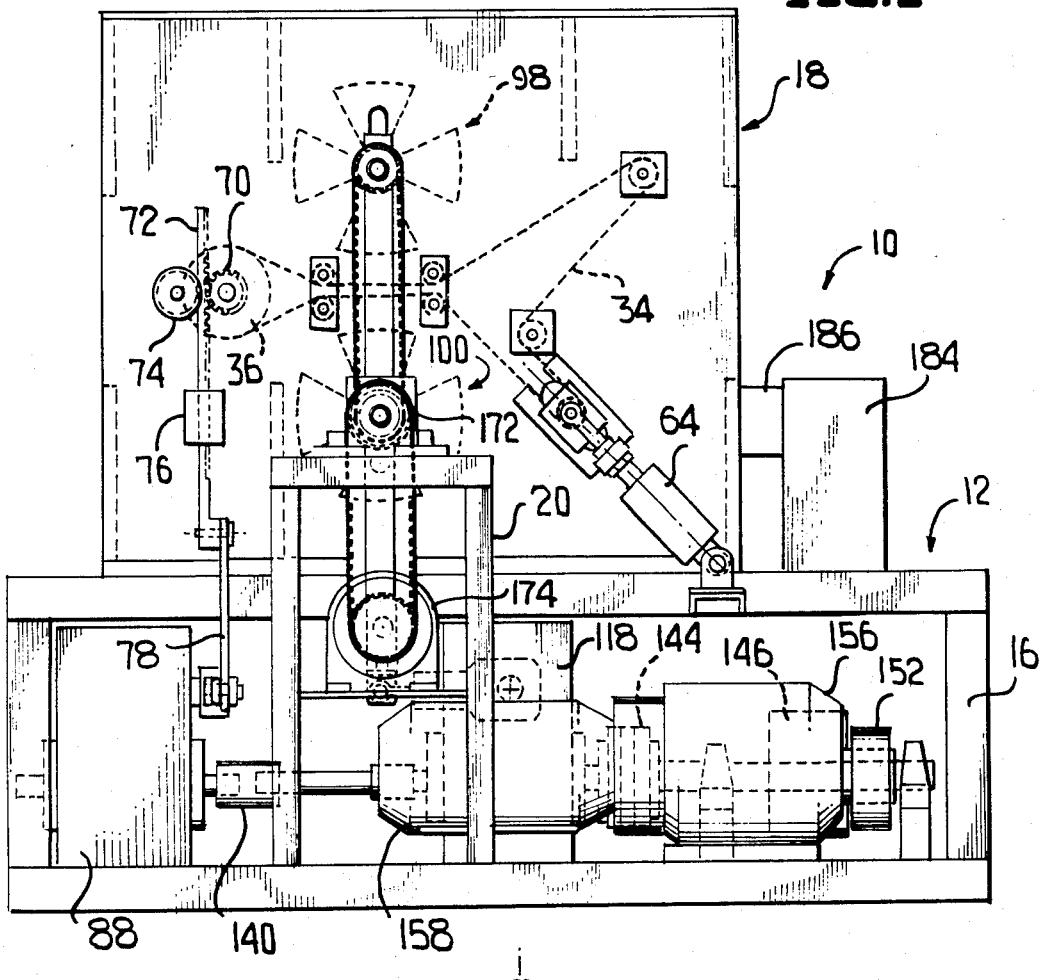
FIG. 2 is a front elevational view of the apparatus taken generally along the line 2—2 of FIG. 1.
Figure 6:
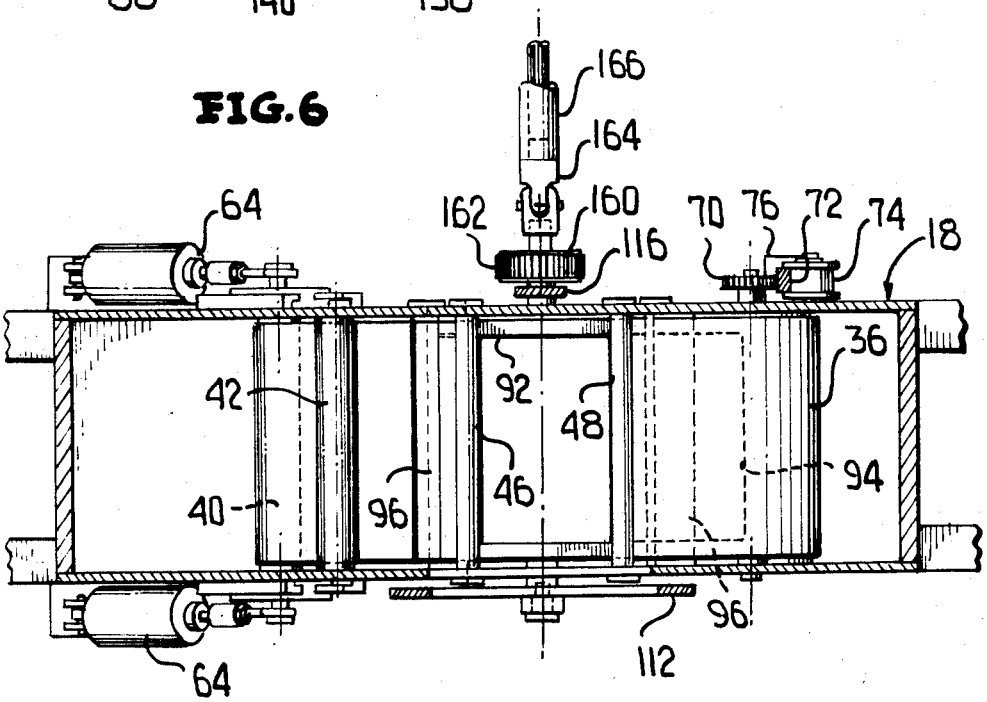
FIG. 6 is a horizontal sectional view taken generally along the lines 6—6 of FIG. 4 and shows further the details of the apparatus.

As is best shown in FIG. 3, the tensioning roller 40 has shaft ends 56 which are mounted in slide blocks 58 guided within guides 60 carried by a respective one of the walls 22, 24. Each of the slide blocks 58 has connected thereto the shaft 62 of a fluid cylinder 64 which has its opposite end mounted on a bracket 66 carried by a portion of the frame 60. In this manner the dryer fabric 34 is relievably tensioned.

Figure 7:
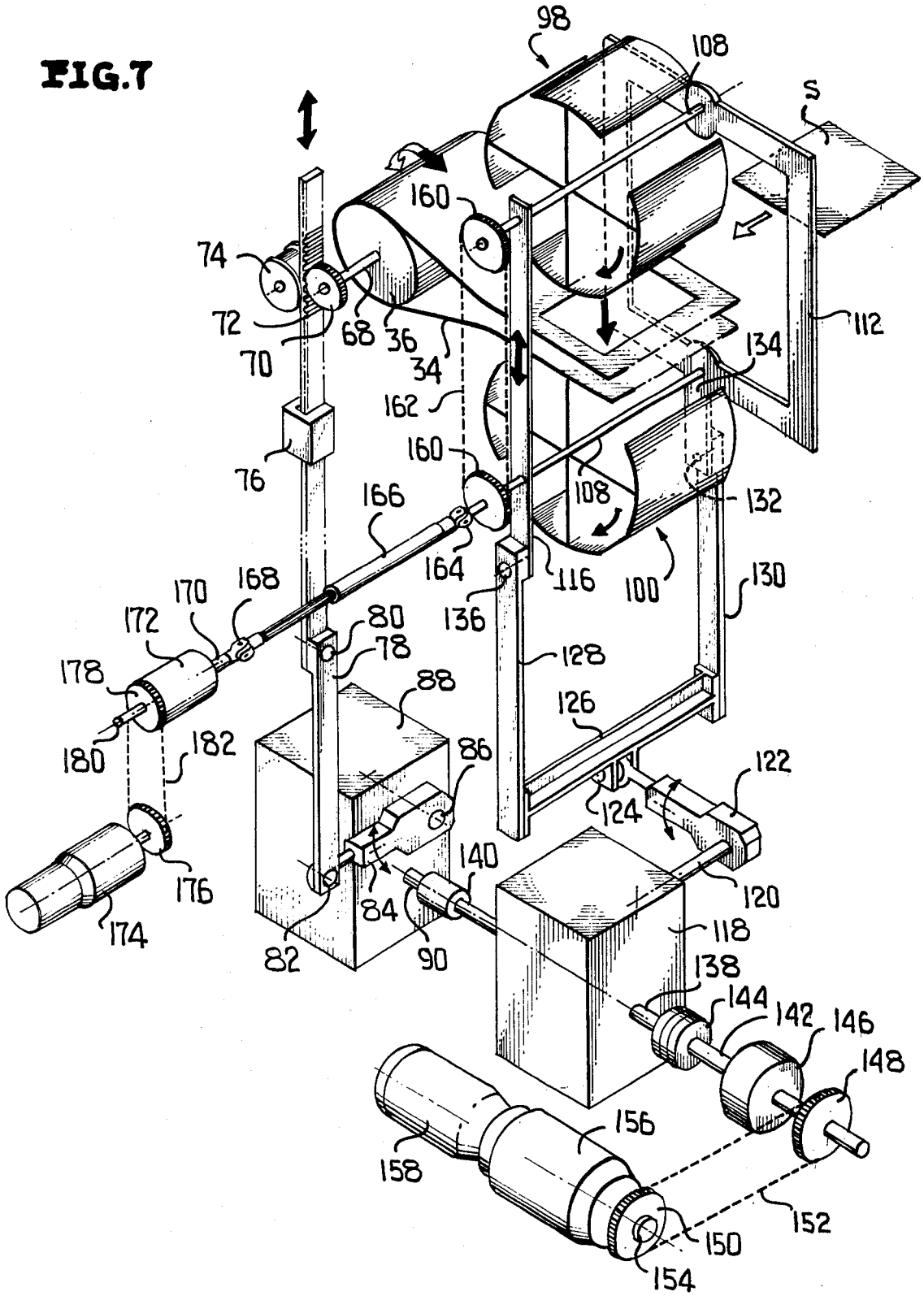
FIG. 7 is a schematic perspective view showing the overall details of the apparatus and the drive train therefor.

The positioning drum 38 is carried by a shaft 68 which is suitably journalled in the walls 22, 24 of the chamber 18. One end of the shaft 68, as is best shown in FIG. 7, is provided with a driven gear 70 which is meshed with a vertically reciprocating rack 72. The rack 72 is held in contact with the gear 70 by a back-up roll 74.

A lower portion of the rack 72 is positioned by means of a guide 76 for vertical movement only. The lower end of the rack 72, which may be in the form of a plain bar, is pivotally connected to a connecting rod 78 by a pivot 80. The lower end of the connecting rod 78 is connected by a pivot 82 to one end of a crank arm 84. The crank arm 84 is carried by an output shaft 86 of a Furgeson drive 88. The drive 88 is specifically constructed to effect an oscillation of the crank arm 84.

The Furgeson drive 88 has an input shaft 90, which when rotated, will effect a controlled vertical reciprocation of the rack 78 which will thus, in turn, effect a controlled back and forth rotation or oscillation of the positioning drum 36. The reader will observe that the dryer fabric 34 has two openings 92, 94 therethrough. The openings 92, 94 are sequentially center with respect to the dryer fabric runs 44, 54 by the oscillation of the positioning drum 36.

Figure 5:
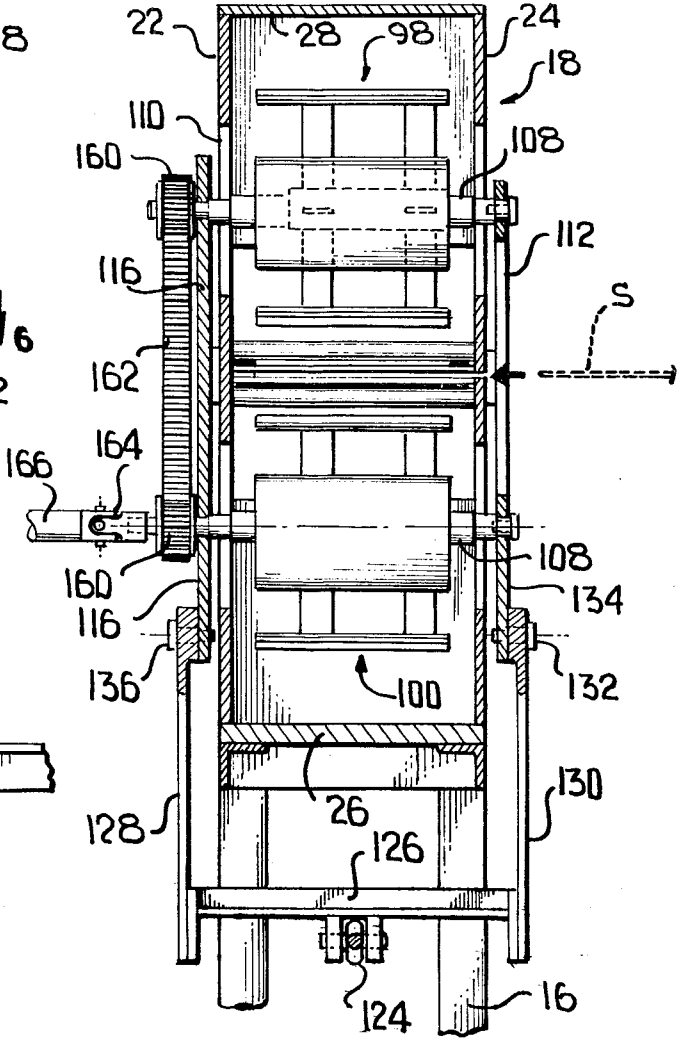
FIG. 5 is a transverse vertical sectional view taken generally along the line 5—5 of FIG. 4 and shows further the details of the apparatus.

According to the practice of this invention a test paper sheet (hand sheet) is to be placed between the runs 44, 54 to be dryed under controlled conditions, as will be described hereinafter. For this purpose, there is positioned between the walls 22, 24 a pair of sheet holders 96 which are positioned to hold a sheet between the runs 44, 54. The wall 24 is provided with an opening therethrough (not shown) through which a test sheet may be positioned into the holders 96 and removed therefrom as is schematically shown in FIG. 5 with a simulated test sheet being identified by the letter S.

In accordance with this invention, there is also mounted within the chamber 18 a pair of dryers generally identified by the numerals 98 and 100. These dryers are identical with the dryer 98 being disposed above the runs 44, 54 and the dryer 100 being disposed below the runs 44, 54.

In a preferred embodiment of the invention, the dryers 98, 100 are each in the form of a plurality of heads 102, which are circumferentially spaced. Each head 102 carries a heating element 104 which is preferably in the form of an electrical heating element and which heating element includes a contact surface 106 which may be heated to a controlled preselected temperature, the temperature of each head being individually controlled.

At this point attention is directed to the fact that each head 102 is of a circumferential extent and an axial extent to be received through the openings 92, 94 in the dryer fabric 34.

Each of the dryers 98, 100 has a support shaft 108 which is suitably journalled adjacent the opposite ends thereof with the vertical slots 110 formed in the walls 22, 24 of the chamber 18. The ends of these shafts 108 extend beyond the chamber with those ends of the shafts 108 disposed adjacent the wall 24 being carried by a yoke 112 which is best shown in FIG. 7. The ends of the shafts 108 which extend through the front wall 22 are carried by a strap-like vertical support 116 which is best shown in FIG. 7. Thus it will be seen that the dryers 98, 100 are mounted for vertical movement in unison.

Referring now to FIG. 7 in particularly, it will be seen that the drive train of the simulator 10 includes a second Furgeson drive 118. The Furgeson drive 118 has an output shaft 120 which carries a crank arm 122. The Furgeson drive 118 is so constructed so as to effect oscillation of the crank arm 122. The crank arm 122 has a pivotal connection 124 with a connector 126. The connector 126 has fixedly secured to opposite ends thereof connecting bars 128, 130. The connecting bar 130 is pivotally connected at its upper end by means of a pivot 132 to a downwardly directed extension 134 of the yoke 112. In a like manner, the upper end of the connecting bar 128 is connected by a pivotal connection 136 to a lower end of the support 116. It will thus be seen that when the crank arm 122 is oscillated, the dryers 98 and 100 are moved up and down in unison. It is to be understood that the output of the Furgeson drive 118 is such that the crank arm 122 is normally stationary in a neutral position and then is first moved down to move the dryers 98, 100 down and then moves up back to its neutral position where it remains stationary for a selected period of time. The crank arm 122 is then moved upwardly to elevate the dryers 98, 100 and then downwardly to its neutral position once again to return the dryers 98, 100 to their neutral positions.

At this time it is pointed out that the Furgeson drive 118 has input shaft 138 which extends entirely through the Furgeson drive 118 and is coupled to the input shaft 98 of the Furgeson drive 88 by means of a coupling 140.

The drive system also includes a jack shaft 142 which is suitably journalled for rotation and which is coupled to the input shaft 138 by a coupling 144. The jack shaft 142 has incorporated therein a clutch 146 so as to control the operation of the drive system whereby the simulator may be inactive when a test sheet is being placed therein or removed therefrom.

The jack shaft 142 is driven by means of a sprocket 148 from a sprocket 150 by means of a suitable drive chain or belt 152. The sprocket 150 is carried by a shaft 154 of a reduction gearing 156 to which there is connected a variable speed drive motor 158.

Still referring to FIG. 7, it is to be understood that in order to sequentially position the individual heads 102 of the dryer 98, 100 for engagement with a test sheet, those ends of the shaft 108 which extends through the front wall 22 of the chamber 18 also extend through the support bar 116 and are provided with drive sprockets or gears 160 which are connected together with a drive belt or chain 162 for rotation of the dryers 98 and 100 in unison in a step-by-step manner.

The lower one of the shafts 108 has coupled thereto a universal joint 164 which in turn has connected thereto one end of a telescoping drive shaft 166. The opposite end of the telescoping drive shaft 166 is connected by a second universal joint 168 to an output shaft 170 of a drive unit 172. The drive unit 172 is constantly provided with an input from a combination drive motor and reduction gear unit 174 which carries a drive pulley or sprocket 176 and which drive sprocket or pulley 176 is connected to a driven sprocket or pulley 178 of an input shaft 180 of the unit 172 by means of a drive belt or chain 182.

It is to be understood that the drive unit 172 operates to rotate the shaft 170 thereof only one-quarter revolution upon each actuation. It is also to be understood that despite the fact that the drive unit 172 is constantly driven, it is only periodically actuated. The drive unit 172 may be actuated in any desired manner, but preferably in response to the actuation of either the Furgeson unit 88 or the Furgeson unit 118 by means of a suitable control switch system (not shown) which is not part of this invention. It is to be understood that the drive unit 172 is to be actuated only at such time as either the crank arm 122 is stationary or the crank arm 84 is moving as will be described in more detail hereinafter.

It is to be understood that in accordance with this invention, the interior of the chamber 18 is to be maintained at a constant temperature and humidity. To this end there is mounted on the frame 12 adjacent the chamber 18 a temperature and humidity control system 184 having a supply duct 186 which opens into the interior of the chamber 18 through the end wall 30. Inasmuch as the system 184 is an off of the shelf item, and other than controlling the temperature and humidity of the air within the chamber 18 is not a specific feature of the invention, and no further details thereof are set forth here.

OPERATION

Figure 8:
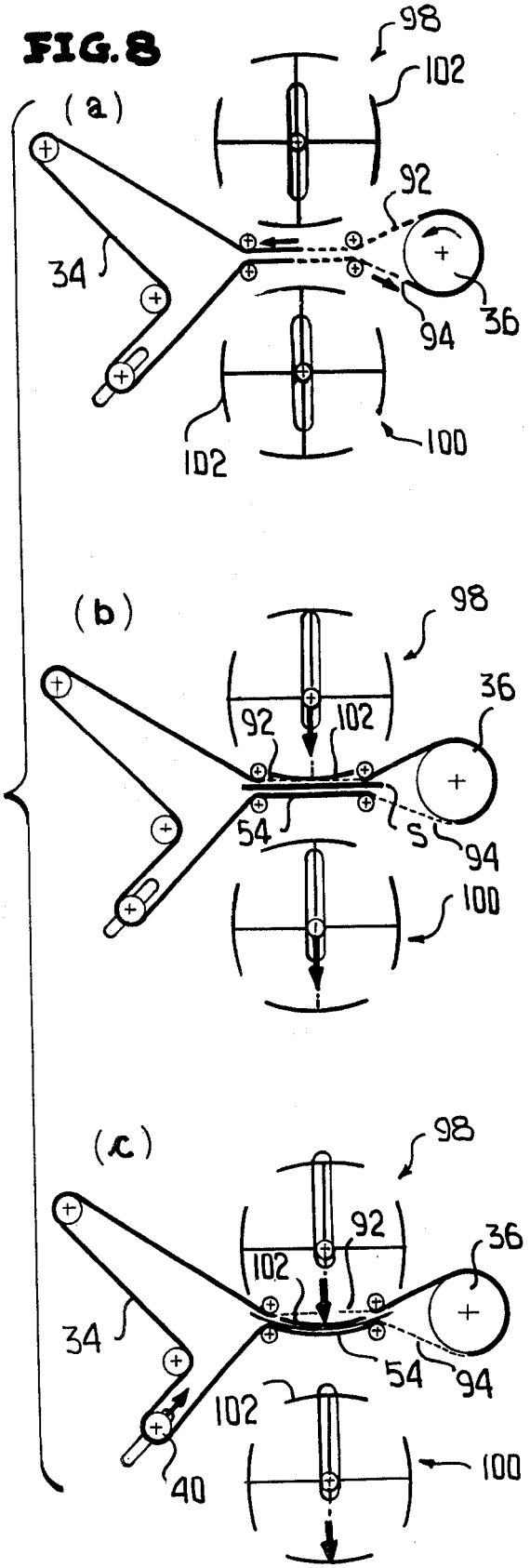
Figure 9:
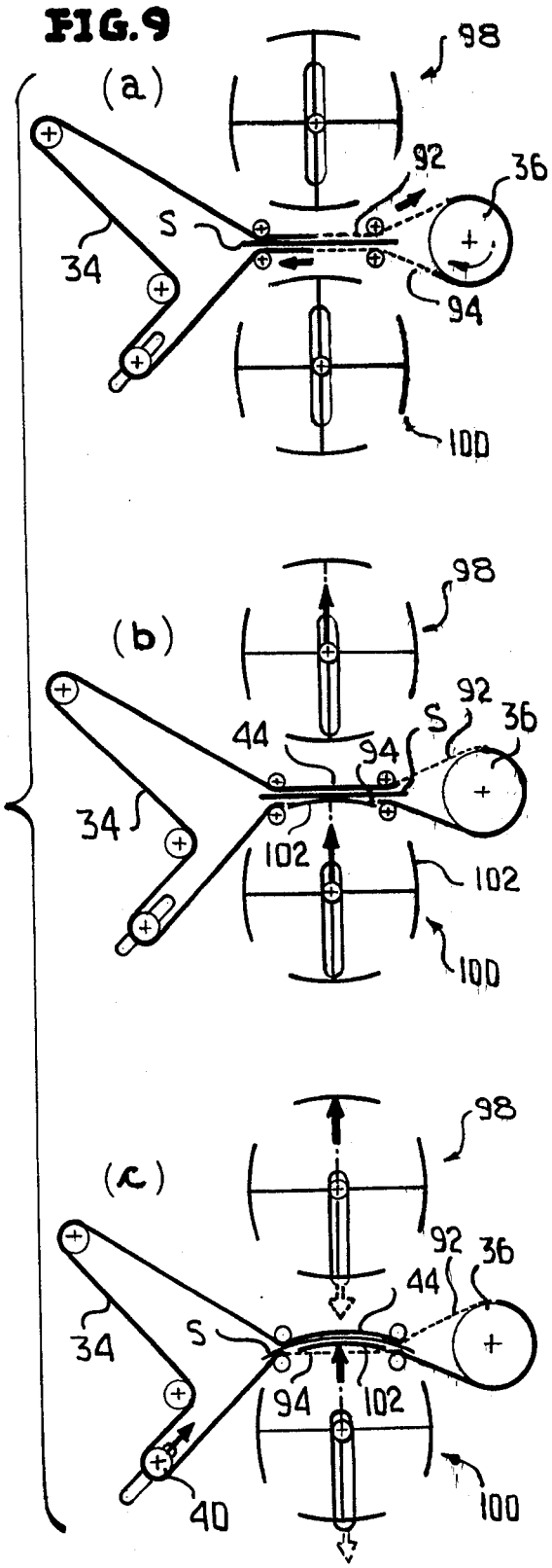

The operation of the simulator 10 is best shown in FIGS. 8 and 9. It is to be understood that a test sheet S of suitable paper or paperboard is mounted between the runs 44, 54. In the position of the apparatus shown in FIG. 8*a*, the dryers 98 and 100 are in their neutral positions, the positioning drum 36 is being rotated in a counter-clockwise direction so as to move the opening 92 into alignment with the dryers 98, 100, and the dryers 98, 100 are being rotated to position a new head 102 of each dryer into an operative position.

Referring now to FIG. 8*b*, it will be seen that rotation of the positioning drum 36 has been completed. Rotation of the dryers 98 and 100 has also been completed. Further, the dryers 98 and 100 have been moved downwardly so that the lowermost dryer head 102 of the dryer 98 is aligned with the opening 92 in the dryer fabric 34. Further, the dryers 98 and 100 have moved downwardly so that the lowermost dryer head 102 is ready to pass through the opening 92.

Referring now to FIG. 8*c*, it will be seen that the lowermost dryer head 102 of the dryer 98 has moved through the opening 92, picked up the test sheet S and has forced the test sheet against the dryer fabric of the lower run 54. Further, the dryer fabric 34 has been deformed to correspond to the contour of the surface of the dryer head 102 whereby the test sheet S is tightly pressed against the dryer fabric 34. At this time it is pointed out that the relievably tensioning of the dryer fabric 34 by the pulley 40 permits the necessary deformation of the dryer fabric 34 with the pulley 40 moving upwardly as indicated by the arrow in FIG. 8*c*.

After the test sheet S has been pressed against the dryer fabric by one of the dryer heads 102 of the upper dryer 98 for the desired amount of time, the dryers 98, 100 are moved upwardly once again to their neutral positions. At this time the dryers 98, 100 are rotated so as to present new dryer heads 102. At the same time the positioning drum 36 is rotated to move the opening 92 to one side and to present the opening 94 into alignment with the dryers 98, 100. This intermediate position is shown in FIG. 9*a*.

After the dryer fabric 34 has been repositioned and the dryers 98, 100 have been rotated, the dryers 98, 100 are moved upwardly with the uppermost dryer head 102 of the dryer 100 passing through the opening 94 as is best shown in FIG. 9*b*. The dryers 98, 100 continue to move upwardly with the uppermost dryer head 102 of the dryer 100 picking up the test sheet S and moving it upwardly against the dryer fabric 34 of the upper run 44. Thus reacting on the opposite faces of the test sheet from that which are carried with the dryer 98 as shown in FIG. 8*c*.

The dryers 98, 100 once again move downwardly to their neutral positions so as to complete a cycle.

The heating cycle is repeated a selected number of times, after which the clutch 146 is disengaged causing the apparatus to come to a standstill. The test sheet may then be removed from the simulator 10 and the moisture content of the test sheet may then be determined. The test sheet can then quickly be reinserted back into the simulator and the operation continued. Thus, the moisture content may be determined a number of times during the operation.

After a predetermined number of cycles, the dryer heads are each rotated 90°, for the next set of compression cycles.

Although only a preferred embodiment of the simulator has been specifically illustrated and described herein, it is to be understood that minor variations may be made in the simulator without departing from the spirit or the scope of the invention as defined by the appended claims.

I claim:

1. A method of simulating the drying action for the purpose of optimizing the operation of a dryer section of a paper machine, said method comprising the provision of two adjacent runs of dryer fabric, placing a test sheet between said dryer fabric runs, moving a first dryer into contact with a first surface of said test sheet and pressing a second and opposite surface of said test sheet against one of said dryer fabric runs, removing said first dryer from said test sheet, engaging said test sheet second surface with a second dryer and forcing said first surface of said test sheet against the other of said dryer fabric runs, removing said second dryer from said test sheet, and removing said test sheet for inspection.

2. A method according to claim 1 wherein each run of said dryer fabric is provided with an opening therethrough for the passage of an adjacent one of said dryers, and shifting said dryer fabric runs to align sequentially each opening of said dryer fabric with a respective one of said dryers for passage of said respective dryer through an adjacent opening for said contract with said test sheet.

3. A method according to claim 2 wherein shifting of said dryer fabric is automatically coordinated with movement of said dryers.

4. A method according to claim 2 wherein each of said dryers is provided with a plurality of heads and after each engagement with a test sheet, each dryer is rotated to present a different head for engagement with said test sheet.

5. A method according to claim 2 wherein each of said dryers is provided with a plurality of heads, and after each engagement with a test sheet, each dryer is rotated to present a different head for engagement with said test sheet and the rotation of said dryers is coordinated with the movement of said dryers.

6. A method according to claim 1 wherein each of said dryers is provided with a plurality of heads, and after each engagement with a test sheet, each dryer is rotated to present a different head for engagement with said test sheet.

7. A method according to claim 1 wherein said dryers are engaged with said test sheet for a selected number of cycles before the test sheet is removed.

8. A method according to claim 1 wherein said dryer fabric is constantly relievably tensioned whereby said dryer fabric and said test sheet conform to the surface of each of said dryers.

9. A method according to claim 1 wherein said method is effected within a chamber, and a constant temperature and humidity is maintained in said chamber during the performance of said method.

10. A method according to claim 1 wherein said dryers are shifted in unison.

11. Apparatus for simulating the drying action of a paper dryer utilizing a test sheet, said apparatus comprising two adjacent dryer fabric runs, a test sheet holder positioned between said dryer fabric runs, a pair of dryers with each dryer being disposed adjacent one of said dryer fabric runs in opposed relation, means mounting said dryers for movement towards and away from said dryer fabric runs; and means for advancing a first of said dryers towards a remote one of said dryer fabric runs for clamping a first face of a test sheet against said remote dryer fabric run, then to a retracted position, then advancing a second of said dryers towards the other of said dryer fabric runs to clamp a second face of a test sheet against said other dryer fabric run, and then to a retracted position.

12. Apparatus according to claim 11 wherein each of said dryer fabric runs has an opening therethrough of a size to have passed therethrough a respective one of said dryers, and means connected to said dryer fabric for shifting said openings sequentially into alignment with said dryers for passage of a respective dryer therethrough into direct engagement with a test sheet held by said test sheet holder.

13. Apparatus according to claim 12 together with common drive means for said means for advancing and retracting said dryers and said means for shifting said dryer fabric.

14. Apparatus according to claim 12 wherein each of said dryers has a plurality of circumferentially arranged heads, and rotation means connected to each of said dryers for rotation each of said dryers when the same are retracted to present a different head each time to a test sheet.

15. Apparatus according to claim 14 together with means for coordinating the rotation of said dryers with the advancing and retracting of said dryers.

16. Apparatus according to claim 11 wherein each of said dryers has a plurality of circumferentially arranged heads, and rotation means connected to each of said dryers for rotation each of said dryers when the same are retracted to present a different head each time to a test sheet.

17. Apparatus according to claim 11 wherein said dryer fabric runs are part of a continuous dryer fabric web, and there are means constantly relievably tensioning said dryer fabric of said dryer fabric runs, whereby a test sheet and a cooperating part of said dryer fabric may deform to the container of a respective one of said dryers.

18. Apparatus according to claim 11 wherein said dryers, said dryer fabric runs and said test sheet holder are all mounted within a chamber, and there are means for maintaining the interior of said chamber of a constant temperature and humidity.

19. Apparatus according to claim 11 together with means interconnecting said dryers for movement in unison.

20. Apparatus according to claim 14 together with means interconnecting said dryers for both movement and rotation in unison.

* * * * *

UNITED STATES PATENT AND TRADEMARK OFFICE

CERTIFICATE OF CORRECTION

PATENT NO. : 4,477,981

DATED : October 23, 1984

INVENTOR(S) : Lawrence W. Chan

It is certified that error appears in the above-identified patent and that said Letters Patent are hereby corrected as shown below:

First page, first column, correct the name of the assignee to read

--- International Paper Company ---.

Signed and Sealed this

*Sixteenth* Day of *July 1985*

[SEAL]

*Attest:*

DONALD J. QUIGG

*Attesting Officer*

*Acting Commissioner of Patents and Trademarks*